US007925199B2

(12) United States Patent
Tada et al.

(10) Patent No.: US 7,925,199 B2
(45) Date of Patent: Apr. 12, 2011

(54) IMAGE FORMING APPARATUS

(75) Inventors: Kaoru Tada, Osaka (JP); Nobuhiko Kita, Osaka (JP); Sei Onuma, Osaka (JP); Ryoh Idehara, Hyogo (JP); Kazuyoshi Kondo, Osaka (JP); Yuusuke Furuichi, Osaka (JP); Genta Hagiwara, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 276 days.

(21) Appl. No.: 12/232,289

(22) Filed: Sep. 15, 2008

(65) Prior Publication Data

US 2009/0074456 A1 Mar. 19, 2009

(30) Foreign Application Priority Data

Sep. 14, 2007 (JP) ..... 2007-239885

(51) Int. Cl.
*G03G 15/00* (2006.01)

(52) U.S. Cl. ..... 399/393; 399/124

(58) Field of Classification Search ..... 399/124, 399/388, 398; 271/9.01, 171, 147, 264
See application file for complete search history.

(56) References Cited

U.S. PATENT DOCUMENTS

| | | | |
|---|---|---|---|
| 6,785,502 | B2 | 8/2004 | Kondoh |
| 2007/0110473 | A1 | 5/2007 | Kondo et al. |
| 2007/0110475 | A1 | 5/2007 | Idehara et al. |
| 2007/0166073 | A1 | 7/2007 | Idehara et al. |
| 2007/0246638 | A1 | 10/2007 | Idehara et al. |
| 2008/0007935 | A1 | 1/2008 | Kondo et al. |
| 2008/0050146 | A1 | 2/2008 | Kita et al. |
| 2008/0063425 | A1 | 3/2008 | Idehara et al. |
| 2008/0075502 | A1 | 3/2008 | Tada et al. |

FOREIGN PATENT DOCUMENTS

| | | | |
|---|---|---|---|
| JP | 02081661 | A * | 3/1990 |
| JP | 02-102558 | | 4/1990 |
| JP | 04-064533 | | 2/1992 |
| JP | 07-010298 | | 1/1995 |
| JP | 08-044272 | | 2/1996 |
| JP | 10045279 | A * | 2/1998 |
| JP | 2001-109355 | | 4/2001 |
| JP | 2003321128 | A * | 11/2003 |
| JP | 2006-064888 | | 3/2006 |
| JP | 3914816 | * | 2/2007 |

OTHER PUBLICATIONS

Abstract of JP 2003-321128 published Nov. 11, 2003.

* cited by examiner

*Primary Examiner* — David M Gray
*Assistant Examiner* — Barnabas T Fekete
(74) *Attorney, Agent, or Firm* — Harness, Dickey & Pierce, P.L.C.

(57) ABSTRACT

An image forming apparatus includes a removable body that is removably set in a main body of the image forming apparatus, and an engaging mechanism that causes the removable body and the main body to engage with each other when the removable body is lifted by a user.

7 Claims, 6 Drawing Sheets

IMAGE FORMING APPARATUS

CROSS-REFERENCE TO RELATED APPLICATIONS

The present application claims priority to and incorporates by reference the entire contents of Japanese priority document 2007-239885 filed in Japan on Sep. 14, 2007.

BACKGROUND OF THE INVENTION

1. Field of the Invention

The present invention relates to a technology for preventing a removable body from being pulled or falling from an image forming apparatus.

2. Description of the Related Art

Image forming apparatuses such as copiers, facsimile devices, printers, and printing machines generally include removable bodies such as sheet feeding cassettes in which recording sheets are stacked. The removable body can be pulled or detached from a main body of the image forming apparatus.

In development of an image forming apparatus, downsizing, simplification of configuration, and cost reduction in manufacturing the image forming apparatus have become key challenges. Furthermore, lightweight image forming apparatuses that can be carried by hand are becoming popular.

Typically, an image forming apparatus includes a grip as a handle to be used to place, convey, or move the image forming apparatus. However, when the image forming apparatus is conveyed or moved, it may be difficult to hold the grip in some working environments. In this case, the image forming apparatus may be conveyed by holding a removable body.

During such conveying or moving operation, the removable body may be pulled or detached from a main body of the image forming apparatus because the removable body is removably set in the image forming apparatus. Therefore, the removable body or the image forming apparatus may fall or be damaged.

The same situation may occur when the image forming apparatus is conveyed or moved by holding the grip.

With weight reduction of an image forming apparatus, the image forming apparatus can be easily carried by a user, whereby the above situation occurs more often.

Japanese Patent Application Laid-open No. 2006-064888, Japanese Patent Application Laid-open No. H08-044272, and Japanese Patent Application Laid-open No. 2003-321128 disclose a technology for setting a removable body in an image forming apparatus such that the removable body is not removed while the image forming apparatus is conveyed or moved.

In the technology disclosed in Japanese Patent Application Laid-open No. 2006-064888, a sheet feeding cassette is locked to prevent detachment from the image forming apparatus by using a link component with a level bolt before shipping. In the technology disclosed in Japanese Patent Application Laid-open No. H08-044272, when the image forming apparatus is conveyed, a sheet feeding cassette is locked and not detached from the image forming apparatus by an operation of pulling a handle used for conveyance of the image forming apparatus. In the technology disclosed in Japanese Patent Application Laid-open No. 2003-321128, when a grip arranged in the image forming apparatus is held by hand, a lever works to lock a sheet feeding cassette to prevent detachment from the image forming apparatus.

Japanese Utility-Model Application Laid-open No. H02-102558 and Japanese Patent Application Laid-open No. 2001-109355 also disclose a technology about a grip.

However, in the technology disclosed in Japanese Patent Application Laid-open No. 2006-064888, the sheet feeding cassette is locked and not detached from the image forming apparatus only before shipping. When the image forming apparatus starts operating, the sheet feeding cassette is unlocked. Therefore, when the image forming apparatus is conveyed or moved after start of the operation, the sheet feeding cassette or the image forming apparatus may fall or be damaged.

The technology disclosed in Japanese Patent Application Laid-open No. H08-044272 is suitable for a relatively large-size image forming apparatus because a handle used for conveyance is accommodated inside of the image forming apparatus. Therefore, the technology puts limitation on downsizing of an image forming apparatus. When the image forming apparatus in this technology is conveyed or moved by holding a removable body without pulling the handle, the removable body or the image forming apparatus may fall or be damaged.

In the technology disclosed in Japanese Patent Application Laid-open No. 2003-321128, a lever is used to lock the sheet feeding cassette. Therefore, the technology also puts limitation on downsizing of an image forming apparatus and simplification of a configuration of an image forming apparatus. When the image forming apparatus in this technology is conveyed or moved by holding, for example, a removable body without using the handle, the removable body or the image forming apparatus may fall or be damaged.

In the technologies disclosed in Japanese Utility-Model Application Laid-open No. H02-102558 and Japanese Patent Application Laid-open No. 2001-109355, the removable body is not locked. Therefore, the removable body can easily fall or be damaged when the image forming apparatus is conveyed or moved.

As described above, the technology for preventing the removable body from being detached from the image forming apparatus when shipping the image forming apparatus or when a proper handle is held for conveying the image forming apparatus have already been disclosed. However, a technology for preventing the removable body from detaching from the image forming apparatus when the image forming apparatus is conveyed or moved by holding the removable body has not been disclosed.

The removable body such as a sheet feeding cassette is a relatively large component in the image forming apparatus and is often arranged at a bottom of the image forming apparatus. Therefore, when the image forming apparatus is conveyed or moved, the removable body is often held. Thus, there is a demand of a technology for preventing the removable body from detaching from the image forming apparatus.

SUMMARY OF THE INVENTION

It is an object of the present invention to at least partially solve the problems in the conventional technology.

According to an aspect of the present invention, there is provided an image forming apparatus that includes a removable body that is removably set in a main body of the image forming apparatus; and an engaging mechanism that causes the removable body and the main body to engage with each other when the removable body is lifted by a user.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
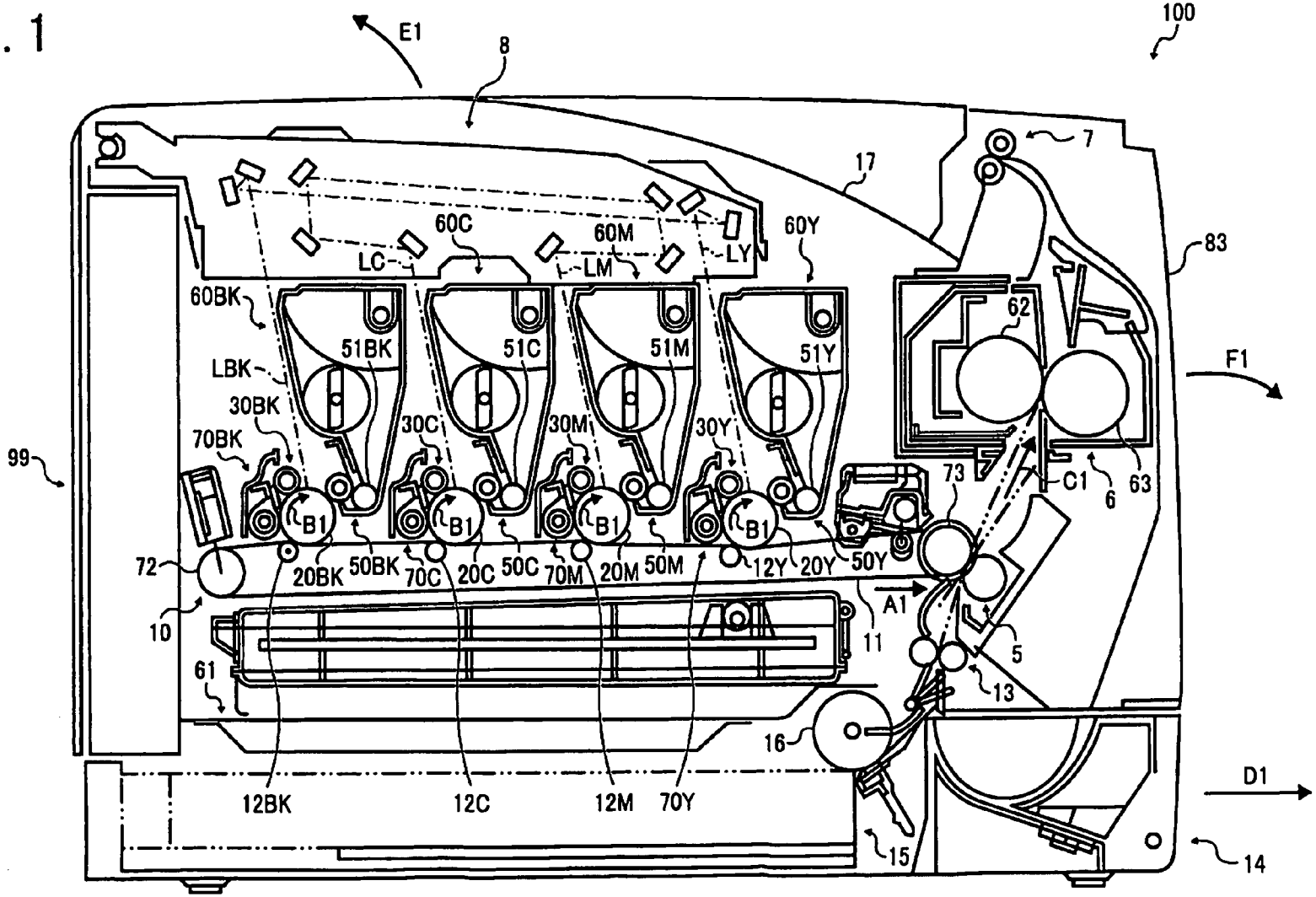
FIG. 1 is a schematic diagram of an image forming apparatus according to an embodiment of the present invention.

FIG. 1 is a schematic diagram of an image forming apparatus 100 according to an embodiment of the present invention. The image forming apparatus 100 is assumed as a laser printer in the below embodiments. However, the present invention can be applied to another type of a color image forming apparatus that can form a color image, such as a printer, a facsimile device, a copier, and a multifunction product that has functions of both a copier and a printer. The image forming apparatus 100 performs image forming processing based on an image signal corresponding to image information sent from external terminals. Even when the image forming apparatus 100 is a facsimile device, the same image forming processing is performed. Image forming can be performed on a sheet recording medium such as a plain paper typically used for copying, an OHP sheet, a thick sheet such as a card or a postcard, or an envelope.

The image forming apparatus 100 is a tandem type that has a plurality of cylindrical photosensitive drums 20Y, 20M, 20C, and 20BK arranged in parallel to each other. Each of the photosensitive drums 20Y, 20M, 20C, and 20BK serves as an image carrier on which an image in each corresponding color of yellow, magenta, cyan, and black is formed.

The photosensitive drums 20Y, 20M, 20C, and 20BK have the same diameters and are arranged at regular intervals on a side of an outer peripheral surface of a transfer belt 11. The outer peripheral surface is a surface on which an image is formed. The transfer belt 11 is an endless belt serving as an intermediate transfer belt and arranged substantially in the center of inside of a main body 99 of the image forming apparatus 100.

The photosensitive drums 20Y, 20M, 20C, and 20BK are aligned in that order from upstream of an A1 direction indicated by an arrow in FIG. 1. The photosensitive drums 20Y, 20M, 20C, and 20BK are provided in image stations 60Y, 60M, 60C, and 60BK serving as an image forming unit to form an image in each color of yellow, magenta, cyan, and black, respectively.

The transfer belt 11 can move in the A1 direction at a position opposing to the photosensitive drums 20Y, 20M, 20C, and 20BK. A visible image, that is, a toner image, is formed on each of the photosensitive drums 20Y, 20M, 20C, and 20BK, and then superimposed onto the transfer belt 11 moving in the A1 direction. Then, the superimposed image is collectively transferred from the transfer belt 11 to a printing sheet (not shown) as a recording medium.

Superimposing and transferring of each toner image onto the transfer belt 11 are performed at each transfer position between each of the photosensitive drums 20Y, 20M, 20C, and 20BK and the transfer belt 11 at a shifted timing from upstream to downstream in the A1 direction by applying voltage from each of primary transfer rollers 12Y, 12M, 12C, and 12BK. The primary transfer rollers 12Y, 12M, 12C, and 12BK serve as transfer chargers and are arranged opposite to the photosensitive drums 20Y, 20M, 20C, and 20BK via the transfer belt 11, respectively. Thus, a toner image formed on each of the photosensitive drums 20Y, 20M, 20C, and 20BK is superimposed and transferred to the same position of the transfer belt 11 while the transfer belt 11 moves in the A1 direction.

The transfer belt 11 is an elastic belt made of an elastic member such as a rubber agent. The transfer belt 11 can be formed of a single layer or a multiple layer part of which is made of an elastic member. As commonly used, the transfer belt 11 can be also made of fluorine resin, polycarbonate resin, or polyimide resin, or can be an inelastic belt.

The image forming apparatus 100 includes the image stations 60Y, 60M, 60C, and 60BK, a transfer belt unit 10, and a secondary transfer roller 5. The transfer belt unit 10 is arranged below and opposite to the photosensitive drums 20Y, 20M, 20C, and 20BK and serves as an intermediate transfer device including the transfer belt 11. The secondary transfer roller 5 is arranged such that the secondary transfer roller 5 comes into contact with the transfer belt 11 at a position opposing to the transfer belt 11. The secondary transfer roller 5 is a member of a transfer device and rotated in the same direction in which the transfer belt 11 rotates.

The image forming apparatus 100 also includes a cleaning device (not shown) serving as an intermediate-transfer-belt cleaning device and an optical scanning device 8. The cleaning device is arranged opposite to the transfer belt 11 and includes an intermediate-transfer cleaning blade to clean a surface of the transfer belt 11. The optical scanning device 8 is arranged above and opposite to the image stations 60Y, 60M, 60C, and 60BK and serves as an optical writing device.

The image forming apparatus 100 also includes a sheet feeding device 61 in which printing sheets (sheets) to be conveyed between the photosensitive drums 20Y, 20M, 20C, and 20BK and the transfer belt 11 are stacked, a pair of registration rollers 13, and a sensor (not shown). A sheet conveyed from the sheet feeding device 61 is sent by the registration rollers 13 toward a transfer unit between the transfer belt 11 and the secondary transfer roller 5 at a predetermined timing corresponding to a timing at which a toner image is formed in each of the image stations 60Y, 60M, 60C, and 60BK. The sensor detects that a leading edge of the sheet reaches the registration rollers 13.

The image forming apparatus 100 also includes a fixing device 6, a pair of discharging rollers 7, a discharging tray 17, and toner bottles (not shown). A sheet to which a toner image is transferred and that is conveyed in a direction indicated by an arrow C1 of FIG. 1 enters the fixing device 6 that has a roller fixing system. The toner image is fixed on the sheet by the fixing device 6. The sheet that has passed through the fixing device 6 is discharged outside the main body 99 by the discharging rollers 7. The sheet discharged outside by the discharging rollers 7 is stacked on the discharging tray 17 serving as a discharging unit that is arranged on the main body 99. Toner of each color of yellow, magenta, cyan, and black is contained in each of the toner bottles.

The transfer belt unit 10 includes the transfer belt 11, the primary transfer rollers 12Y, 12M, 12C, and 12BK, a transfer inlet roller 73, and a driven roller 72. The transfer inlet roller 73 serves as a driving roller and as one of a plurality of wound members over which the transfer belt 11 is stretched. The transfer inlet roller 73 is driven with rotation of a motor (not shown) as a driving source, so that the transfer belt 11 is rotatably driven in the A1 direction.

The fixing device 6 includes a fixing roller 62 that accommodates a heat source and a pressing roller 63 that is brought into pressure-contact with the fixing roller 62. A sheet carrying a toner image is passed through a fixing unit that is a pressure-contact unit between the fixing roller 62 and the pressing roller 63. Thus, the toner image is fixed on a surface of the sheet by heat and pressure.

The optical scanning device 8 scans and exposes a scanning surface of each of the photosensitive drums 20Y, 20M, 20C, and 20BK with each of laser beams LY, LM, LC, and LBK based on image signals, so that electrostatic latent images are formed.

The optical scanning device 8 can be opened in a direction indicated by an arrow E1 of FIG. 1 by opening a cover (not shown) of the main body 99. When the optical scanning device 8 is opened, a later-described process cartridge arranged in each of the image stations 60Y, 60M, 60C, and 60BK can be separately taken out in an upper direction of the main body 99.

The sheet feeding device 61 includes a feeding tray 15 on which sheets are stacked, a feeding roller 16 by which sheets stacked on the feeding tray 15 are fed, and a sheet feeding cassette 14 that accommodates the feeding tray 15. The sheet feeding cassette 14 is a removable body that can be removed from the main body 99 in a direction indicated by an arrow D1 of FIG. 1.

The sheet feeding device 61, particularly the sheet feeding cassette 14 and the neighborhood of the sheet feeding cassette 14 are described below in detail.

The downstream side of the D1 direction is on a front side of the image forming apparatus 100.

When a front cover 83 that is a part of the main body 99 and arranged on a front side of the image forming apparatus 100 is opened, the secondary transfer roller 5 can be exposed in a direction indicated by an arrow F1 of FIG. 1. Therefore, when a sheet is jammed at around the secondary transfer roller 5, it is easy to remove the jammed sheet.

A configuration of the image station 60Y that includes the photosensitive drum 20Y is explained as an example. The other image stations 60M, 60C, and 60BK have the same configurations as the image station 60Y. Therefore, the same reference numerals with corresponding symbols M, C, and BK as in the configuration of the image station 60Y are given to the other image stations 60M, 60C, and 60BK and their detailed explanation is not repeated. Y, M, C, and BK appended to the reference numerals indicate yellow, magenta, cyan, and black, respectively.

The image station 60Y includes, around the photosensitive drum 20Y along its rotating direction B1 that is clockwise, the primary transfer roller 12Y, a cleaning device 70Y that cleans a surface of the photosensitive drum 20Y, a charging device 30Y that applies a high voltage to the photosensitive drum 20Y, and a developing device 50Y that develops an electrostatic latent image on the photosensitive drum 20Y. The developing device 50Y includes a developing roller 51Y opposing to the photosensitive drum 20Y.

The photosensitive drum 20Y, the cleaning device 70Y, the charging device 30Y, and the developing device 50Y are integrally arranged as a process cartridge. The process cartridge can be detached from or attached to the main body 99. Thus, the process cartridge can be used as an exchangeable component, so that its maintenance is enhanced.

The surface of the photosensitive drum 20Y is uniformly charged by the charging device 30Y while the photosensitive drum 20Y rotates in the B1 direction. An electrostatic latent image in yellow is formed on the photosensitive drum 20Y while the photosensitive drum 20Y is exposed and scanned with the laser beam LY from the optical scanning device 8. The electrostatic latent image is formed by scanning with the laser beam LY in a main-scanning direction that is a direction perpendicular to a sheet conveying direction and in a sub-scanning direction that is a peripheral direction of the photosensitive drum 20Y along with rotation of the photosensitive drum 20Y in the B1 direction.

A charged yellow toner supplied by the developing device 50Y is adhered to the electrostatic latent image. The electrostatic latent image is developed into a yellow toner image. The yellow toner image is primary transferred to the transfer belt 11 that moves in the A1 direction by the primary transfer roller 12Y. Toner remained on the photosensitive drum 20Y after the transfer is removed by the cleaning device 70Y and stored. Thus, the photosensitive drum 20Y is ready for next charging by the charging device 30Y.

A toner image in each corresponding color is formed on each of the photosensitive drums 20M, 20C, and 20BK similarly as described above. Each toner image is primary transferred in sequence to the same position of the transfer belt 11 by the primary transfer rollers 12M, 12C, and 12BK.

The toner image superimposed on the transfer belt 11 is moved to a secondary transfer unit opposing to the secondary transfer roller 5 along with the rotation of the transfer belt 11 in the A1 direction and is secondary transferred to a sheet by the secondary transfer unit.

The printing sheet fed by the sheet feeding device 61 is conveyed to the transfer unit between the transfer belt 11 and the secondary transfer roller 5 by the registration rollers 13 based on a detected signal from the sensor at a timing at which a leading edge of the toner image on the transfer belt 11 reaches the secondary transfer roller 5.

The sheet to which the toner images in different colors are collectively transferred is conveyed in the C1 direction and entered the fixing device 6 where the toner image is fixed on the sheet. Thus, a full color image is formed on the printing sheet. The sheet that has been passed through the fixing device 6 is stacked on the discharging tray 17 by the discharging rollers 7. The transfer belt 11 after the secondary transfer is cleaned by the cleaning device and is ready for the next primary transfer.

Figure 2A:
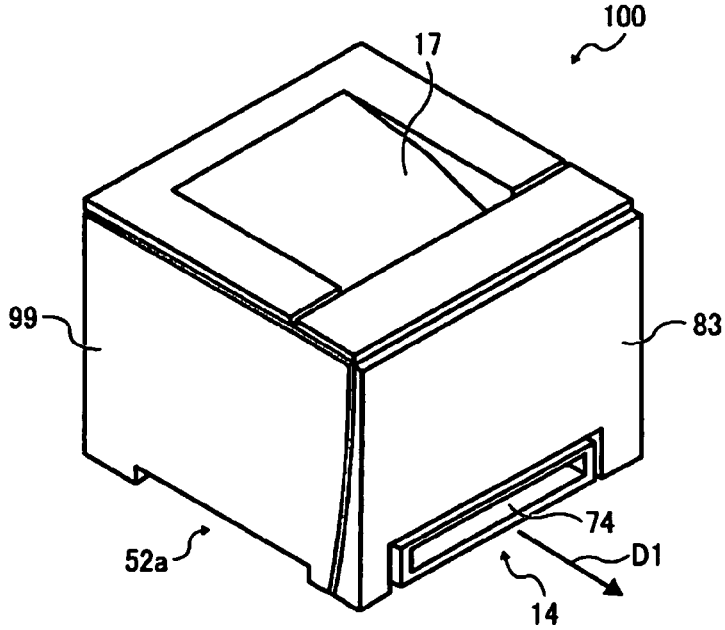
FIGS. 2A and 2B are external perspective views of the image forming apparatus shown in FIG. 1.
Figure 2B:
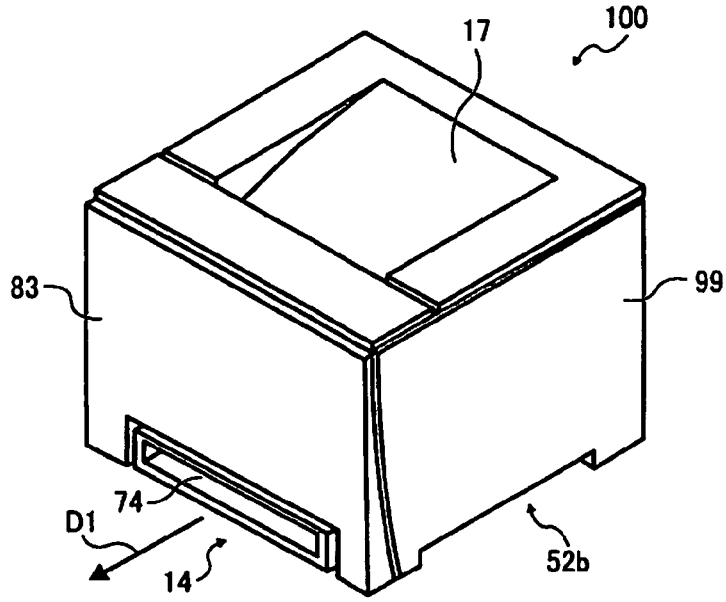

As shown in FIGS. 2A and 2B, the image forming apparatus 100 includes grips 52*a* and 52*b* and a handle member 74. The grips 52*a* and 52*b* are used to hold the image forming apparatus 100 for conveying or moving the image forming apparatus 100. The handle member 74 is used to pull or pulled out the sheet feeding cassette 14 from the main body 99.

The handle member 74 is formed as concave in a front surface of the sheet feeding cassette 14.

The grips 52*a* and 52*b* are arranged on both side surfaces of the sheet feeding cassette 14 and at a bottom of the main body 99 in parallel to the D1 direction.

Generally, the grips 52*a* and 52*b* are held to convey or move the image forming apparatus 100.

However, when the image forming apparatus 100 that is placed in such a manner that its side is in contact with or in close-contact with a wall is conveyed or moved, the image forming apparatus 100 may be held without using the grips 52*a* and 52*b*.

In this case, the image forming apparatus 100 may be held by holding the handle member 74 that is not arranged to convey or move the image forming apparatus 100. This situation is much likely to occur because the handle member 74 is arranged at the bottom of the image forming apparatus 100.

When the image forming apparatus 100 is held by using the handle member 74 and if the sheet feeding cassette 14, which is removably set in the main body 99, can freely move, the sheet feeding cassette 14 may be pulled or detached from the main body 99 during conveying or moving the image forming apparatus 100. Therefore, the sheet feeding cassette 14 or the image forming apparatus 100 may fall or be damaged.

Figure 3:
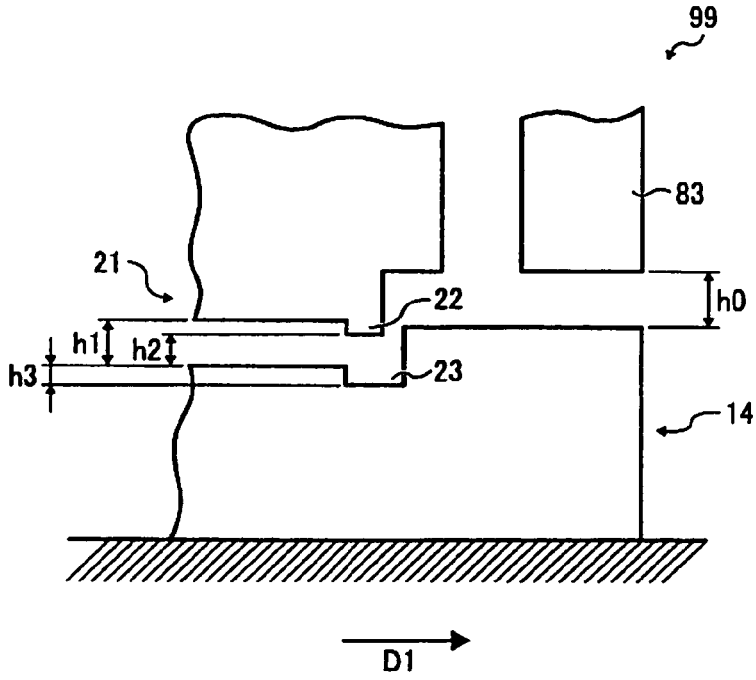
FIG. 3 is a side view of an engaging mechanism arranged in the image forming apparatus shown in FIG. 1.

The image forming apparatus 100 includes an engaging mechanism 21 shown in FIG. 3 for preventing the above situation. When the sheet feeding cassette 14 is lifted by using the handle member 74 to hold the image forming apparatus 100, positions of the main body 99 and the sheet feeding cassette 14 are set by the engaging mechanism 21 such that the sheet feeding cassette 14 cannot be pulled out of the main body 99. In the example shown in FIG. 3, the image forming apparatus 100 is placed on a horizontal plane.

The sheet feeding cassette 14 is arranged such that the sheet feeding cassette 14 is not pulled out of the main body 99 or detached from the image forming apparatus 100 even when the image forming apparatus 100 is conveyed or moved by using the grips 52*a* and 52*b* as long as the image forming apparatus 100 is not extremely inclined. That is, a preventing unit (not shown) that increases friction between the sheet feeding cassette 14 and the main body 99 or engages both of them is arranged. The preventing unit prevents the sheet feeding cassette 14 from being pulled or detached from the main body 99.

The engaging mechanism 21 is arranged on a front side of the sheet feeding cassette 14, that is, near an edge of the side on which the handle member 74 is arranged, which is near the handle member 74. The front side of the sheet feeding cassette 14 and a front side of the front cover 83 are on the same level at their home position where sheets can be supplied from the sheet feeding cassette 14. That is, a part of the front side of the sheet feeding cassette 14 and a part of the front side of the front cover 83 constitute an exterior of the image forming apparatus 100.

The engaging mechanism 21 includes a convex portion 22 and a concave portion 23. The convex portion 22 is arranged on the main body 99 toward the sheet feeding cassette 14. The concave portion 23 is arranged on the sheet feeding cassette 14 at a position corresponding to the convex portion 22 and is formed in a size large and wide enough to fit over the convex portion 22.

In the example shown in FIG. 3, a distance h0 indicates a distance of a gap between the front cover 83 and the sheet feeding cassette 14.

A distance h1 indicates a distance of a gap between the main body 99 except the front cover 83 and the sheet feeding cassette 14 where a part corresponding to the convex portion 22 and a part corresponding to the concave portion 23 are excluded. In other words, the distance of the gap is a distance between a bottom surface of the main body 99 and a top surface of the sheet feeding cassette 14 at upstream of the convex portion 22 and the concave portion 23 in the D1 direction.

A distance h2 indicates a distance of a gap between the top surface of the sheet feeding cassette 14 and a tip of the convex portion 22 within the distance h1.

A distance h3 indicates a distance of a gap between the top surface of the sheet feeding cassette 14 and a bottom of the concave portion 23 within the distance h1, that is, a depth of the concave portion 23.

That is, h0, h1, h2, and h3 satisfy the following inequalities.

$$h0>h1 \quad (1)$$

$$h2>0 \quad (2)$$

$$h1>h2 \quad (3)$$

$$h3 \geqq h1-h2 \quad (4)$$

Figure 4:
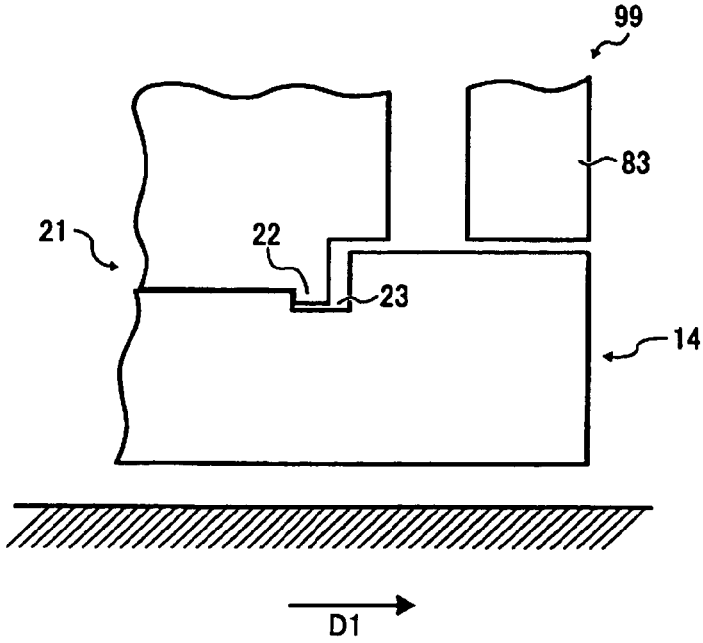
FIG. 4 is a side view for explaining an operation state of the engaging mechanism shown in FIG. 3.

As shown in FIG. 4, when Expression (1) is satisfied and if the sheet feeding cassette 14 is lifted, the front side of the sheet feeding cassette 14 moves upward, bringing the sheet feeding cassette 14 and the front cover 83 closer together. Concretely, the main body 99 is brought into contact with the sheet feeding cassette 14 at a portion of the distance h1 without interference or close contact between the sheet feeding cassette 14 and the front cover 83. Therefore, the convex portion 22 is assuredly inserted and engaged into the concave portion 23.

The convex portion 22 and the concave portion 23 are loosely fitted together. Therefore, when the image forming apparatus 100 is placed at a predetermined position and hands are released from the sheet feeding cassette 14, engagement between the sheet feeding cassette 14 and the main body 99 can be released.

Because the main body 99 is brought into contact with the sheet feeding cassette 14 at a portion of the distance h1, the image forming apparatus 100 can be stably held.

In the example shown in FIG. 4, the main body 99 is arranged in parallel to the sheet feeding cassette 14 at a portion of the distance h1. However, when lifted by using the handle member 74, the upstream side of the sheet feeding cassette 14 in the D1 direction is inclined with respect to the main body 99.

When Expression (2) is satisfied, the sheet feeding cassette 14 in a normal state, that is, in a home position in which the image forming apparatus 100 is not lifted can be assuredly pulled or detached from and attached to the main body 99 without interference with the main body 99. Therefore, the sheet feeding cassette 14 is smoothly detached from or attached to the main body 99 without interference with each other.

When Expressions (1) and (3) are satisfied, if the sheet feeding cassette 14 is lifted, the convex portion 22 can be fitted into the concave portion 23. With Expression (3), the convex portion 22 arranged on a side of the main body 99 is protruded toward the sheet feeding cassette 14 within the distance h1.

When Expressions (1) and (4) are satisfied, if the sheet feeding cassette 14 is lifted, only the tip of the convex portion 22 is not interfered with or brought into contact with the bottom of the concave portion 23 while the main body 99 is brought into contact with the sheet feeding cassette 14 at a portion of the distance h1.

Therefore, local stress does not occur between the sheet feeding cassette 14 and the main body 99. Furthermore, malfunction due to damage caused by the stress can be prevented, and the image forming apparatus 100 can be stably maintained.

As shown in FIG. 4, the sheet feeding cassette 14 and the main body 99 are engaged with each other, so that the sheet feeding cassette 14 is prevented from being pulled or detached from the main body 99 in the D1 direction.

Figure 5:
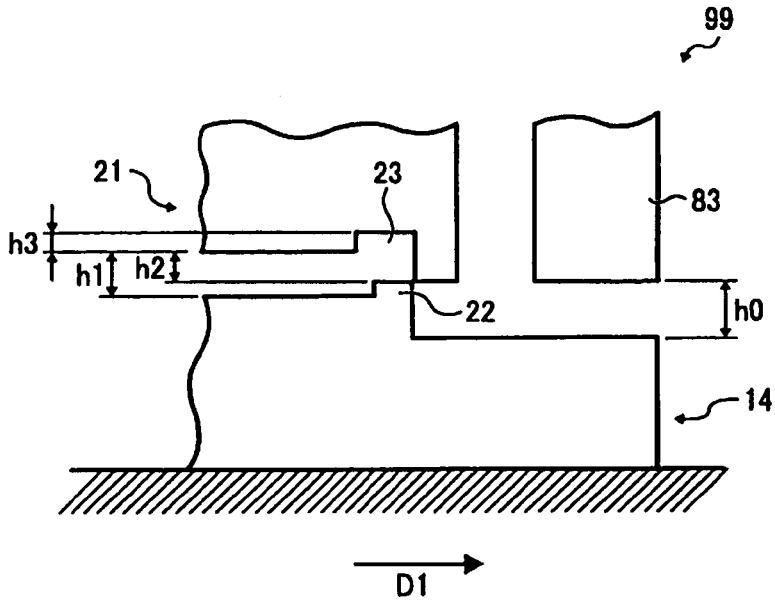
FIG. 5 is a side view of a modification of the engaging mechanism shown in FIG. 3.

As shown in FIG. 5, the convex portion 22 can be arranged on the sheet feeding cassette 14 and the concave portion 23 can be arranged on the main body 99.

In other words, the convex portion 22 can be arranged on one of the main body 99 and the sheet feeding cassette 14 and the concave portion 23 can be arranged on the other.

Figure 6:
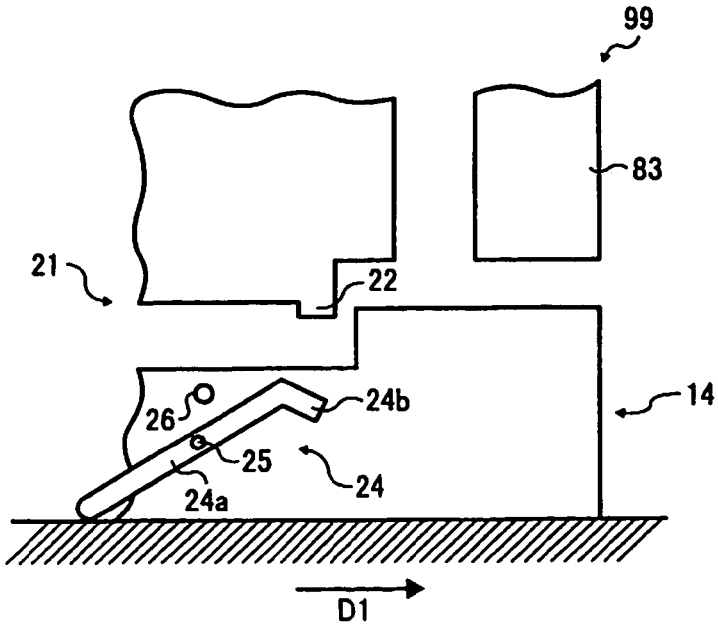
FIG. 6 is a side view of another modification of the engaging mechanism shown in FIG. 3.

Another modification of the engaging mechanism 21 is shown in FIG. 6. The engaging mechanism 21 includes an engaging member 24, a pin 25, and a controlling member 26 in addition to the main body 99 and the sheet feeding cassette 14. The engaging member 24 is arranged integrally with the sheet feeding cassette 14 and can move independent of the main body 99 and the sheet feeding cassette 14. The engaging member 24 is swingably supported by the pin 25 serving as a supporting member, which is protruded on the sheet feeding cassette 14. The controlling member 26 controls movement of the engaging member 24 to be within a predetermined range. As shown in FIG. 6, the image forming apparatus 100 is placed on a horizontal plane.

In this modification, the convex portion 22 is arranged as an engaging portion and the concave portion 23 is not arranged because the engaging member 24 serves as an engaged portion.

The engaging mechanism 21 shown in FIG. 6 is advantageous compared to the engaging mechanism 21 having the concave portion 23 because the engaging mechanism 21 can be applied even the concave portion 23 cannot be arranged because of downsizing of the image forming apparatus 100.

The engaging member 24 has a substantial L shape. A long unit 24*a* of the engaging member 24 is supported by the pin 25. The engaging member 24 is arranged such that the sheet feeding cassette 14 can be pulled or detached from the main body 99 in a normal state.

The length of the long unit 24*a* is set such that a tip of the long unit 24*a* comes into contact with a surface of the floor when the image forming apparatus 100 is placed on a horizontal plane.

The engaging member 24 is supported by the pin 25 at a position that is eccentric to a center of gravity of the engaging member 24. Specifically, a position at which the tip of the long unit 24*a* hangs is supported by the pin 25. Therefore, the engaging member 24 swings counterclockwise by gravity in the example shown in FIG. 6.

The controlling member 26 is positioned away from the engaging member 24 when the image forming apparatus 100 is placed on a floor of horizontal plane. The controlling member 26 is brought into contact with the engaging member 24 when the tip of the long unit 24*a* swings counterclockwise about the pin 25 away from a position where the tip of the long unit 24*a* comes into contact with the floor.

Figure 7:
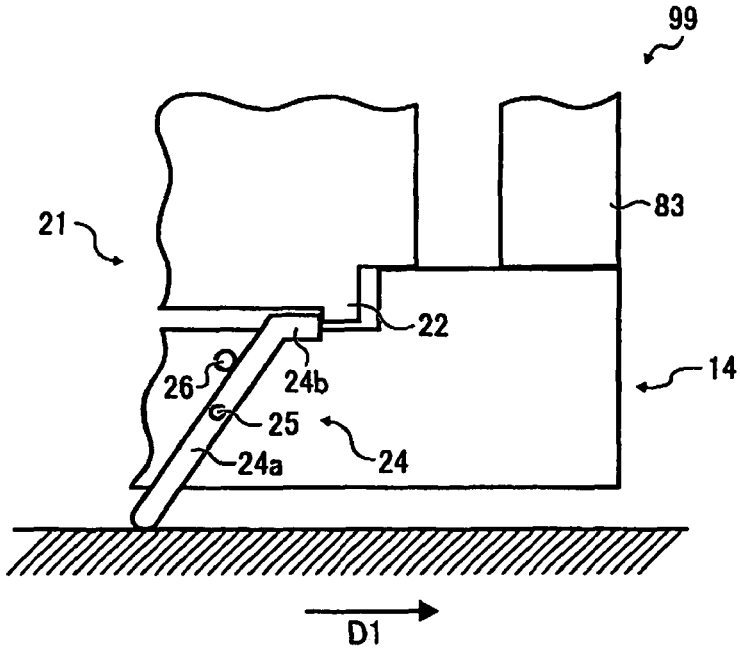
FIG. 7 is a side view for explaining an operating state of the engaging mechanism shown in FIG. 6.

As shown in FIG. 7, when the sheet feeding cassette 14 is lifted and the front side of the sheet feeding cassette 14 moves upward, the engaging member 24 swings such that the tip of the long unit 24*a* hangs. When the front side of the sheet feeding cassette 14 is brought into contact with the front cover 83, a short unit 24*b* of the engaging member 24 is brought into contact and engaged with the convex portion 22. At the same time, the long unit 24*a* is brought into contact and engaged with the controlling member 26, whereby the engaging member 24 is prevented from being swung.

In the example shown in FIG. 7, the sheet feeding cassette 14 and the main body 99 are engaged with each other, so that the sheet feeding cassette 14 is prevented from being pulled or detached from the main body 99 in the D1 direction.

Even if the sheet feeding cassette 14 and the main body 99 are further lifted and the tip of the long unit 24*a* is away from the floor, engaged state is maintained because the engaging member 24 is prevented from being swung by the controlling member 26.

Under this state, a portion similar to the concave portion 23 is formed by the tip of the short unit 24*b* and the sheet feeding cassette 14.

Figure 8:
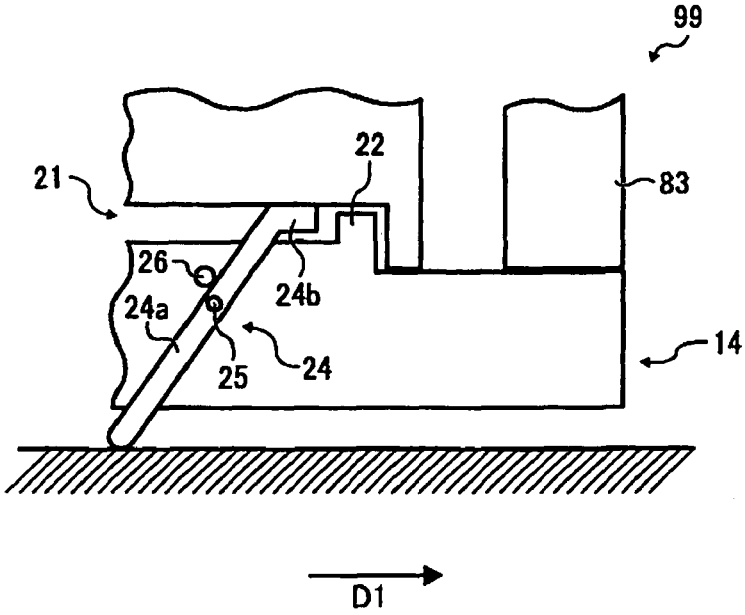
FIG. 8 is a side view of a still another modification of the positioning unit shown in FIG. 3.

As shown in FIG. 8, the engaging mechanism 21 having the engaging member 24 can be applied when the convex portion 22 is arranged on the sheet feeding cassette 14.

In other words, the convex portion 22 can be arranged on at least one of the main body 99 and the sheet feeding cassette 14.

The engaging member 24 can be arranged on the main body 99 by adjusting its shape or size irrespective of whether the convex portion 22 is arranged on the main body 99 or the sheet feeding cassette 14.

Likewise, the controlling member 26 can be arranged on the main body 99.

Figure 9A:
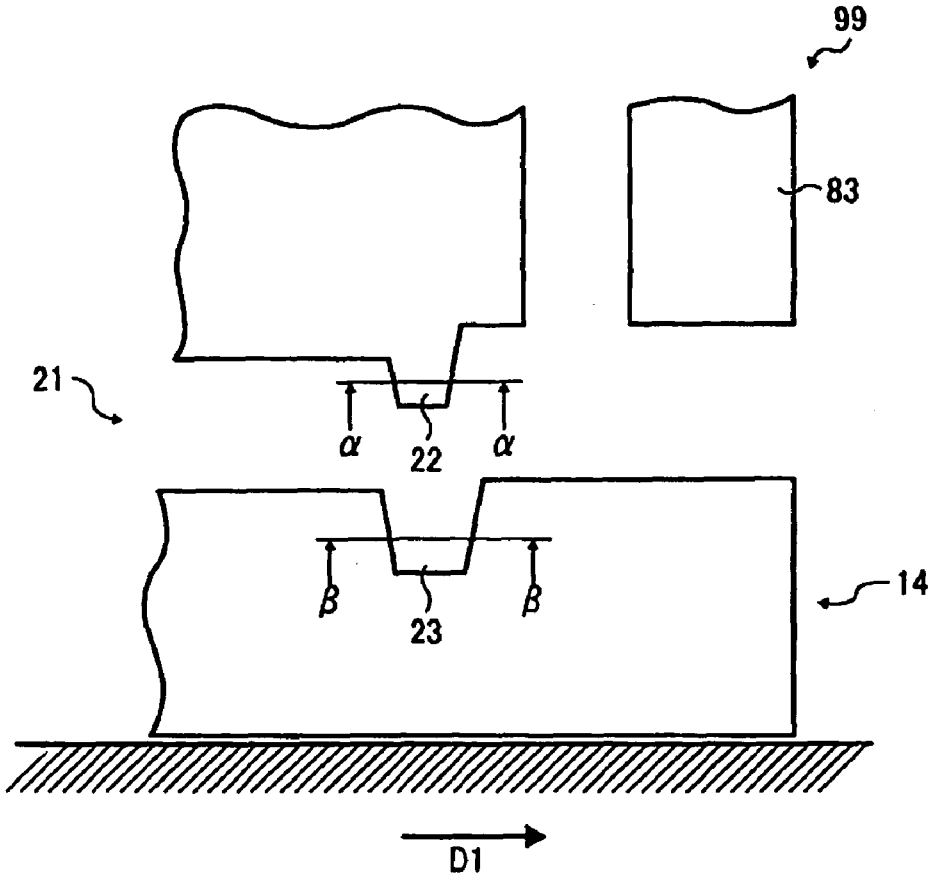
FIG. 9A is a side view of a still another modification of the engaging mechanism shown in FIG. 3.

The tip of the short unit 24*b* that is engaged with an outer surface of the convex portion 22, an inner surface of the concave portion 23, or the convex portion 22 is provided in a hanging condition with respect to the main body 99 and the sheet feeding cassette 14 in the above examples. Alternatively, as shown in FIG. 9A, the outer surface, the inner surface, or the tip can be formed in a taper shape with respect to the main body 99 and the sheet feeding cassette 14 such that the tip of the convex portion 22 and the bottom of the concave portion 23 are made narrower.

Therefore, the convex portion 22 and the concave portion 23 or the tip of the short unit 24*b* can be engaged with each other more assuredly and smoothly. As a result, the main body 99 and the sheet feeding cassette 14 are assuredly engaged with each other.

Figure 9B:
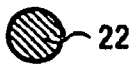
FIG. 9B is a cross section taken from line α-α of FIG. 9A.
Figure 9C:
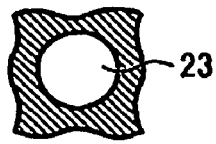
FIG. 9C is a cross section taken from line β-β of FIG. 9A.

When the convex portion 22 and the concave portion 23 are conical, their sections are those shown in FIGS. 9B and 9C. In this case, like the engaging mechanism 21 that includes the convex portion 22 and the concave portion 23 described above, it is also preferable that the convex portion 22 and the concave portion 23 are loosely fitted together.

Thus, it is preferable to make each of the sections to be fitted to each other to assuredly engage the main body 99 with the sheet feeding cassette 14.

The present invention is not limited to the above embodiments and can be applied to various devices without departing from spirits and scope of the present invention.

For example, instead of the tandem image forming apparatus, the present invention can be applied to a one-drum image forming apparatus in which a color image is formed by sequentially forming and superimposing toner images in different colors on one photosensitive drum. Furthermore, the present invention can be applied to a monochrome image forming apparatus in which toner images in different colors are directly transferred onto a printing sheet without using an intermediate transfer element.

The image forming apparatus can be, not limited to the electrophotographic image forming apparatus as described above, an ink-jet image forming apparatus in which ink is used or a printing machine such as a mimeograph machine.

The removable body can be undetached from the image forming apparatus body; however it should be at least pulled from the image forming apparatus.

Effects described in the embodiment of the present invention are cited only as the most preferable ones provided by the present invention and not thus limited.

According to an aspect of the present invention, a removable body can be prevented from being unintentionally pulled or fallen during an operation of conveying or moving an image forming apparatus. Therefore, it is possible to assure safety in the operation and prevent damages of the image forming apparatus caused by falling of the removable body or the image forming apparatus.

Furthermore, according to another aspect of the present invention, the engaging mechanism is effective even when the removable body is inclined by holding a grip during the operation of conveying or moving the image forming apparatus.

Moreover, according to still another aspect of the present invention, the engaging mechanism can have a relatively simple configuration and in a relatively small size.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a removable body that is removably set in a main body of the image forming apparatus; and an engaging mechanism that causes the removable body and the main body to engage with each other when an upward force is applied to the removable body by a user such that the removable body can not be removed from the main body, wherein the removable body can be removed when the upward force is not given by the user.

2. The image forming apparatus according to claim 1, further comprising:

a handle member arranged near the removable body, wherein the handle member is configured to be used by the user to at least one of pull the removable body and lift the removable body.

3. The image forming apparatus according to claim 1, wherein the engaging mechanism includes a first part that is a part of the main body and a second part that is a part of the removable body.

4. The image forming apparatus according to claim 3, wherein the first part is a concave portion, and the second part is a convex portion.

5. The image forming apparatus according to claim 3, wherein the first part is a convex portion, and the second part is a concave portion.

6. The image forming apparatus according to claim 1, wherein the engaging mechanism includes an engaging member arranged on the main body so as to engage with the removable body.

7. The image forming apparatus according to claim 1, wherein the engaging mechanism includes an engaging member arranged on the removable body so as to engage with the main body.

* * * * *